US007934636B2

(12) United States Patent
Lin et al.

(10) Patent No.: US 7,934,636 B2
(45) Date of Patent: May 3, 2011

(54) SINGLE-PIECE PACKAGING PLATE FOLDABLE TO FORM BOXES HAVING DIFFERENT SIZES

(75) Inventors: Te-An Lin, Tapei Hsien (TW); Chia-Chia Huang, Taipei Hsien (TW)

(73) Assignee: Aopen Inc., Taipei Hsien (TW)

( * ) Notice: Subject to any disclaimer, the term of this patent is extended or adjusted under 35 U.S.C. 154(b) by 950 days.

(21) Appl. No.: 11/801,207

(22) Filed: May 8, 2007

(65) Prior Publication Data

US 2008/0054056 A1 Mar. 6, 2008

(30) Foreign Application Priority Data

Aug. 29, 2006 (TW) ..... 95131752 A

(51) Int. Cl.

| | |
|---|---|
| ***B65D 5/00*** | (2006.01) |
| ***B65D 23/00*** | (2006.01) |
| ***B65D 25/04*** | (2006.01) |
| ***B65D 5/52*** | (2006.01) |

(52) U.S. Cl. ..... 229/101; 229/103; 229/120.08; 229/120.01; 206/736

(58) Field of Classification Search ..... 229/101, 229/120.08, 120.01, 103; 206/736
See application file for complete search history.

(56) References Cited

U.S. PATENT DOCUMENTS

| | | | | | |
|---|---|---|---|---|---|
| 897,608 | A | * | 9/1908 | Ely | 206/748 |
| 1,188,825 | A | * | 6/1916 | Potter | 206/326 |
| 2,015,278 | A | * | 9/1935 | Meyer | 229/120.18 |
| 2,596,331 | A | * | 5/1952 | Ferguson | 229/120.012 |
| 2,614,746 | A | * | 10/1952 | Frankenstein | 229/120.09 |
| 2,640,643 | A | * | 6/1953 | Frankenstein | 229/164 |
| 2,891,710 | A | * | 6/1959 | Repking | 206/742 |
| 2,916,194 | A | * | 12/1959 | Frankenstein | 206/45.21 |
| 3,111,254 | A | * | 11/1963 | Thyen | 229/101 |
| 3,127,088 | A | * | 3/1964 | Jacobson | 229/101.2 |
| 3,241,738 | A | * | 3/1966 | Freiman | 229/120.011 |
| 3,934,720 | A | * | 1/1976 | Kratochvil, Jr. | 206/326 |
| 4,136,817 | A | * | 1/1979 | Perry | 229/101 |
| 4,185,741 | A | * | 1/1980 | Schiff et al. | 206/326 |
| 4,294,397 | A | * | 10/1981 | Kohler | 229/120.08 |
| 4,328,923 | A | * | 5/1982 | Graser | 229/101 |
| 4,407,442 | A | * | 10/1983 | Watson et al. | 229/120.18 |
| 5,048,690 | A | * | 9/1991 | Zimmerman | 206/746 |
| 5,170,934 | A | * | 12/1992 | Lemoine | 229/101 |
| 5,303,863 | A | * | 4/1994 | Arasim | 229/227 |

(Continued)

FOREIGN PATENT DOCUMENTS

GB 2167043 A * 5/1986

*Primary Examiner* — Gary E Elkins
*Assistant Examiner* — Latrice Byrd
(74) *Attorney, Agent, or Firm* — Kilpatrick Townsend & Stockton LLP

(57) ABSTRACT

A single-piece packaging plate foldable to form boxes having different sizes is provided for a product having a variable size. The packaging plate has an elongated plate portion, two side plate portions and two wing portions. The elongated plate portion has a plurality of parallel and spaced-apart preformed fold lines. The side plate portions extend outward from two sides of the elongated portion, and have fold lines at the junctures thereof. The two wing portions can be torn or cut out optionally. Each wing portion has a main wing extending from two sides of an area between sixth and seventh fold lines of the elongated plate portion. The packaging plate is foldable along the fold lines to form a unit body-packaging box or a system-packaging box.

10 Claims, 5 Drawing Sheets

U.S. PATENT DOCUMENTS 5,579,911 A * 12/1996 Werth ..... 206/192
6,357,652 B1 * 3/2002 Evans et al. ..... 229/120.01
6,729,475 B2 * 5/2004 Yuhas et al. ..... 206/746
6,923,316 B2 * 8/2005 Carty et al. ..... 206/232
6,932,219 B2 * 8/2005 Chacko et al. ..... 206/526

* cited by examiner

SINGLE-PIECE PACKAGING PLATE FOLDABLE TO FORM BOXES HAVING DIFFERENT SIZES

CROSS-REFERENCE TO RELATED APPLICATION

This application claims priority of Taiwanese Application No. 095131752, filed on Aug. 29, 2006, the disclosure of which is incorporated herein by reference.

BACKGROUND OF THE INVENTION

1. Field of the Invention

The invention relates to a packaging plate, more particularly to a single-piece packaging plate foldable to form boxes having different sizes.

2. Description of the Related Art

Housings containing electronic components, such as computer housings, are generally placed in an assembled state when transported or displayed in sales outlets. Understandably, the assembled housings are hollow and can occupy a considerable space so that storage and transportation costs are substantially high. Recently, a computer housing that can be changed between a collapsed configuration as shown in FIG. 1 and a non-collapsed configuration as shown in FIG. 2 is commercially available. With such a design, the volume of the computer housing is decreased, and costs for storage and transportation can be reduced accordingly. In FIGS. 1 and 2, the computer housing has a front panel 10 and a collapsible remaining housing portion 11.

When the computer housing is delivered from a factory, the computer housing is packaged and transported with the front panel 10 disassembled from the remaining housing portion 11 and with the remaining housing portion 11 collapsed as shown in FIG. 1. When the computer housing 1 reaches a marketing end, the front panel 10 is assembled to the remaining housing portion 11 of the computer housing, and the computer housing in the non-collapsed assembled configuration, as shown in FIG. 2, is packaged for delivery from the marketing end. Therefore, to package the computer housing having the collapsed and non-collapsed configurations, it is necessary to prepare a packaging device for each configuration, thereby wasting packaging materials and aggravating environmental problems.

SUMMARY OF THE INVENTION

Therefore, the object of the present invention is to provide a single-piece packaging plate foldable to form boxes having different sizes.

According to the present invention, a single-piece packaging plate foldable to form boxes having different sizes comprises an elongated plate portion having first and second short sides, first to tenth parallel fold lines that are disposed serially from the first to second short sides in a spaced-apart relationship. The distances between the first and second fold lines, between the third and fourth fold lines and between the sixth and eighth fold lines are D1. The distances between the second and third fold lines, between the fourth and sixth fold lines, and between the fifth and eighth fold lines are D2. D2 is greater than D1.

The packaging plate further comprises two side plate portions, and two wing portions. The side plate portions project respectively from two sides of an area between the second and third fold lines of the elongated plate portion. The elongated plate portion and each of the side plate portions has a fold line (A) at a juncture therebetween. Each of the side plate portions has a fold line (B) and a fold line (C) that are spaced apart in parallel from the fold line (A). A distance from the fold lines (A) to (B) is D1. A distance from the fold line (A) to (C) is substantially equal to a distance from the second fold line to the first short side of the elongated plate portion and a distance from the third fold line to the fifth fold line.

The wing portions can be removed optionally from the elongated plate portion. Each of the wing portions has a main wing projecting from one side of an area between the sixth to seventh fold lines of the elongated plate portion. The main wing has a length substantially equal to a distance from the seventh to ninth fold lines.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
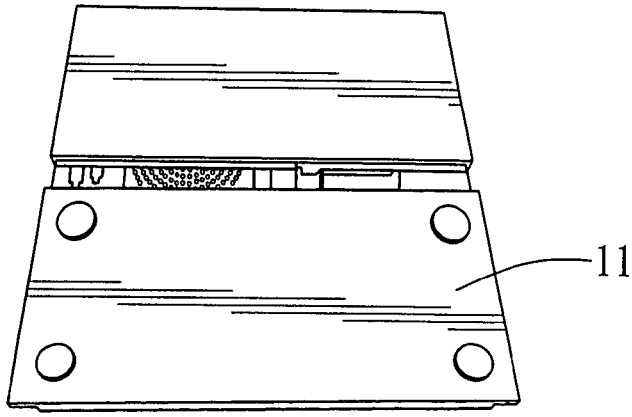
FIG. 1 PRIOR ART
FIG. 1 is a perspective view showing a conventional computer housing in a collapsed configuration.
Figure 2:
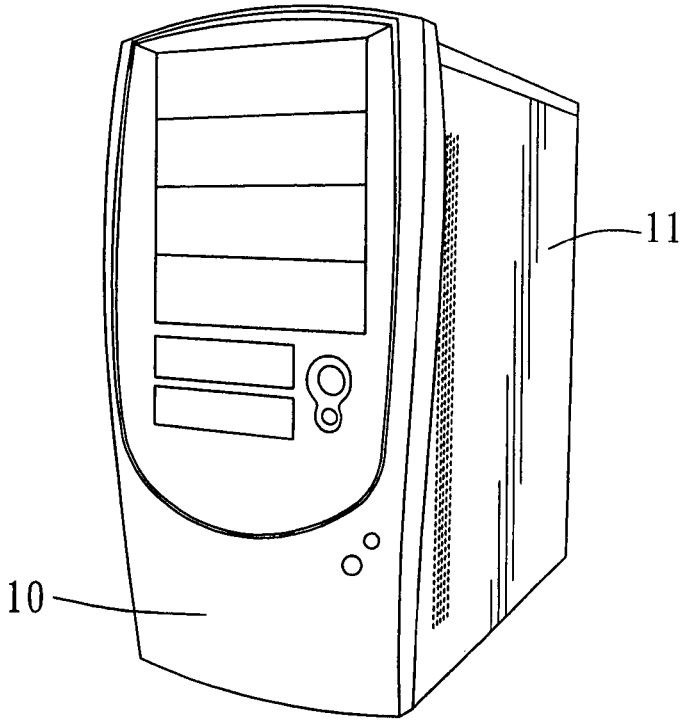
FIG. 2 PRIOR ART
FIG. 2 is a perspective view showing a conventional computer housing having a front panel assembled therewith in a non-collapsed configuration.
Figure 3:
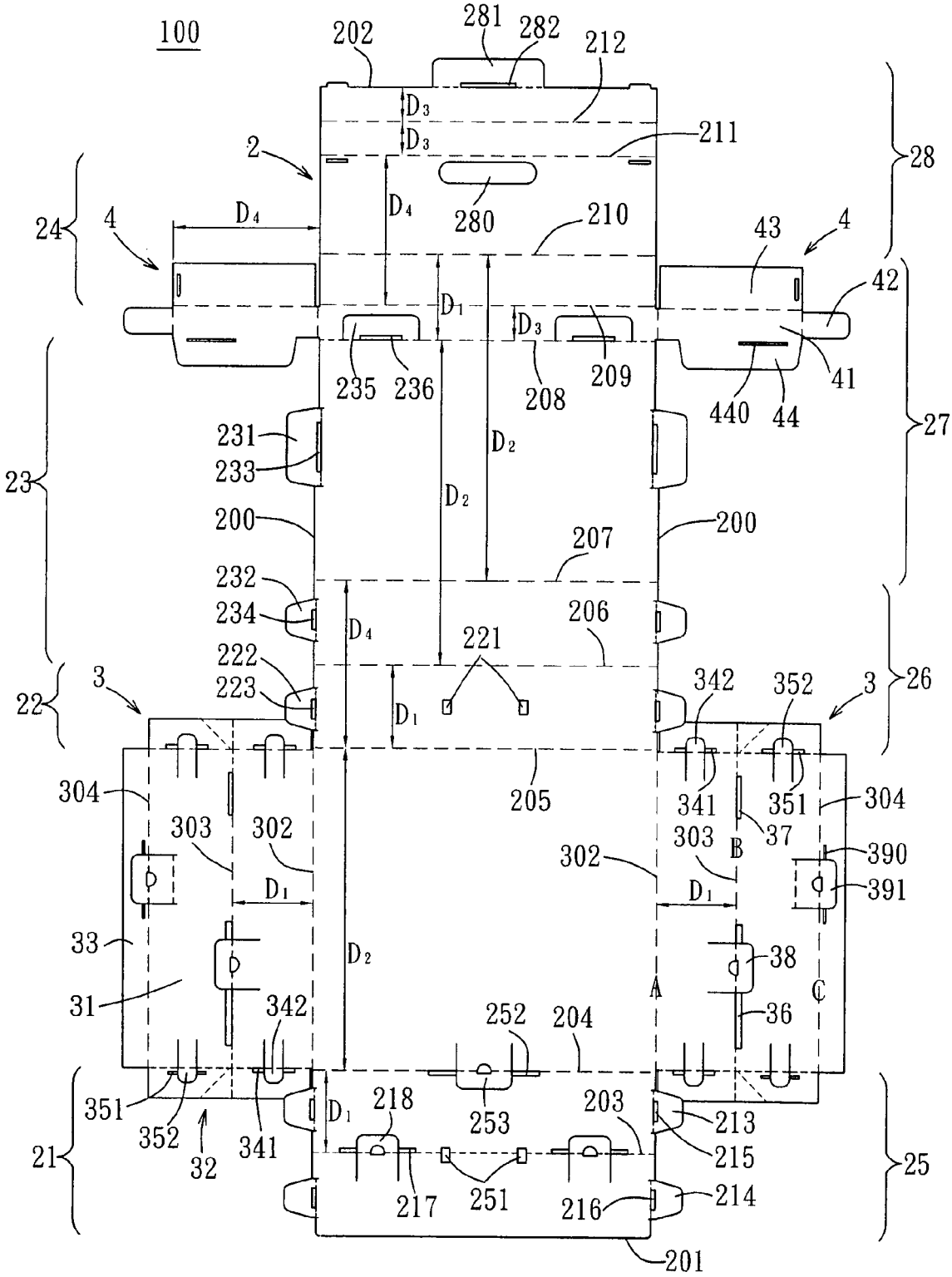
FIG. 3 is a plan view of a preferred embodiment of the single-piece packaging plate foldable to form boxes having different configurations according to the present invention.
Figure 4:
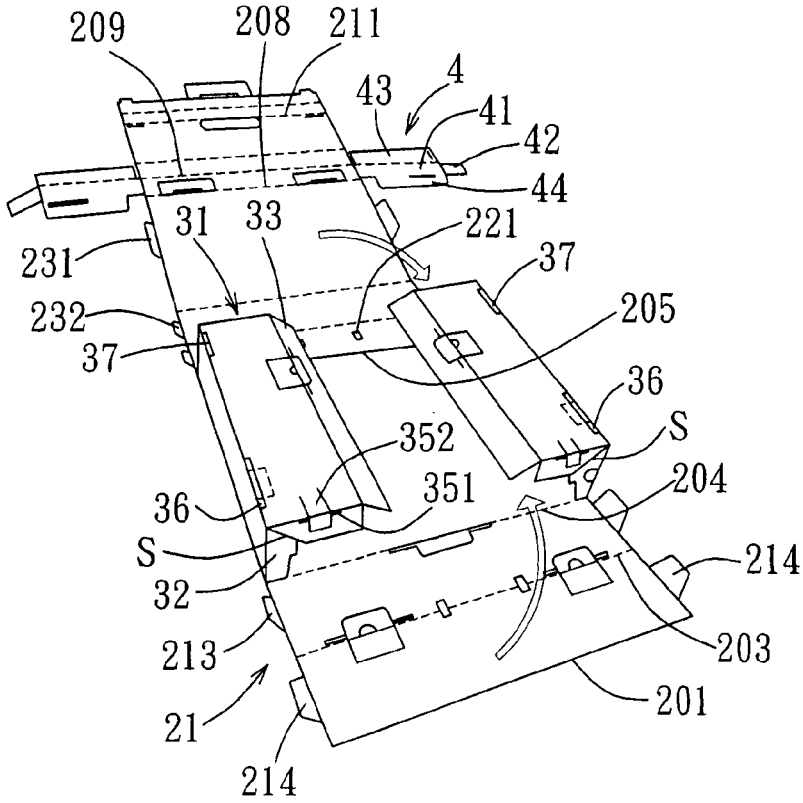
FIG. 4 is a perspective view showing the preferred embodiment that undergoes a folding operation to form a unit body-packaging box.
Figure 5:
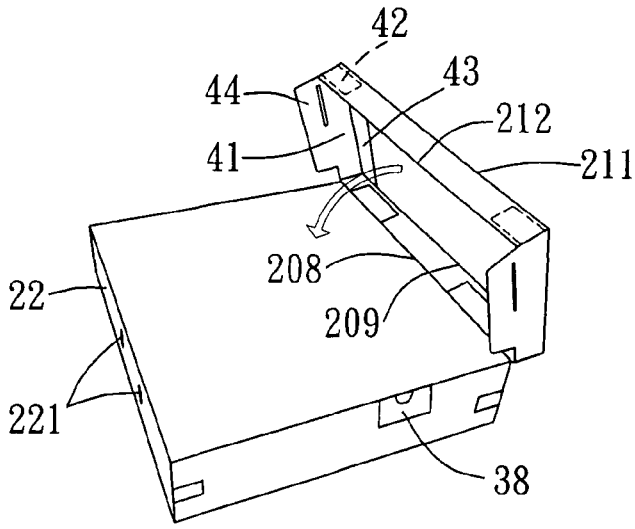
FIG. 5 is a perspective view showing that the preferred embodiment is about to form the unit body-packaging box.

Referring to FIG. 3, a single-piece packaging plate 100 foldable to form boxes having different sizes according to a preferred embodiment of the present invention is shown. The packaging plate 100 may be used for packaging a computer housing (not shown) that can be changed between a collapsed configuration and a non-collapsed configuration. The packaging plate may be folded to form a unit body-packaging box 101 shown in FIG. 6, or a system-packaging box 102 shown in FIG. 8 depending on the configuration of the computer housing to be packaged.

The packaging plate 100 includes an elongated plate portion 2, two side plate portions 3 projecting respectively and symmetrically from two opposite long sides 200 of the elongated plate portion 2, and two wing portions 4 projecting symmetrically and respectively from the opposite long sides 200 of the elongated plate portion 2.

The elongated plate portion 2 has opposite first and second short sides 201, 202 that are interconnected by the long sides 200, and first to tenth fold lines 203-212 preformed between and in parallel to the first and second short sides 201 and 202. The distances between the first and second fold lines 203 and 204, between the third and fourth fold lines 205 and 206, and between the sixth and eighth fold lines 208 and 210 are D1. The distances between the second and third fold lines 204 and 205, between the fourth and sixth fold lines 206 and 208, and between the fifth and eighth fold lines 207 and 210 are (D2). The distances between the sixth and seventh fold lines 208 and 209, between the ninth and tenth fold lines 211 and 212, and between the tenth fold line 212 and the second short side 202 are D3. D1, D2 and D3 have the following relationship: D2>D1>D3.

Each side plate portion 3 is substantially rectangular and includes a main plate section 31, first fixing sections 32 extending respectively from two short sides of the main plate section 31, and a second fixing section 33 extending from one long side of the main plate section 31. A fold line (A) designated by numeral 302 is disposed at a juncture between each side plate portion 3 and the elongated plate portion 2 and located between the second and third fold lines 204, 205 of the elongated plate portion 2. Further, each side plate portion 3 has parallel and spaced-apart preformed fold lines (B) and (C) respectively designated by numerals 303 and 304. The distance between the fold lines (A)/302 and (B)/303 is (D1). The distance between the fold lines (A)/302 and (C)/304 is equal to the distance between the second fold line 204 and the first short side 201, and is also equal to the distance between the third and fifth fold lines 205 and 207, all of the aforesaid distances being twice the distance D1.

Each wing portion 4 has a main wing 41 extending from the respective long side of the elongated plate portion 2 between the sixth and seventh fold lines 208 and 209, an insert plate 42 projecting from a free end of the respective main wing 41, and two auxiliary plates 43, 44 extending respectively from two long sides of the main wing 41. The length of the main wing 41 is substantially equal to a distance between the seventh and ninth fold lines 209 and 211 and is defined as D4.

The aforesaid packaging plate 100 is further provided with a plurality of projecting plates and apertures, which are described in the following description manifesting the steps of folding the packaging plate 100.

Figure 6:
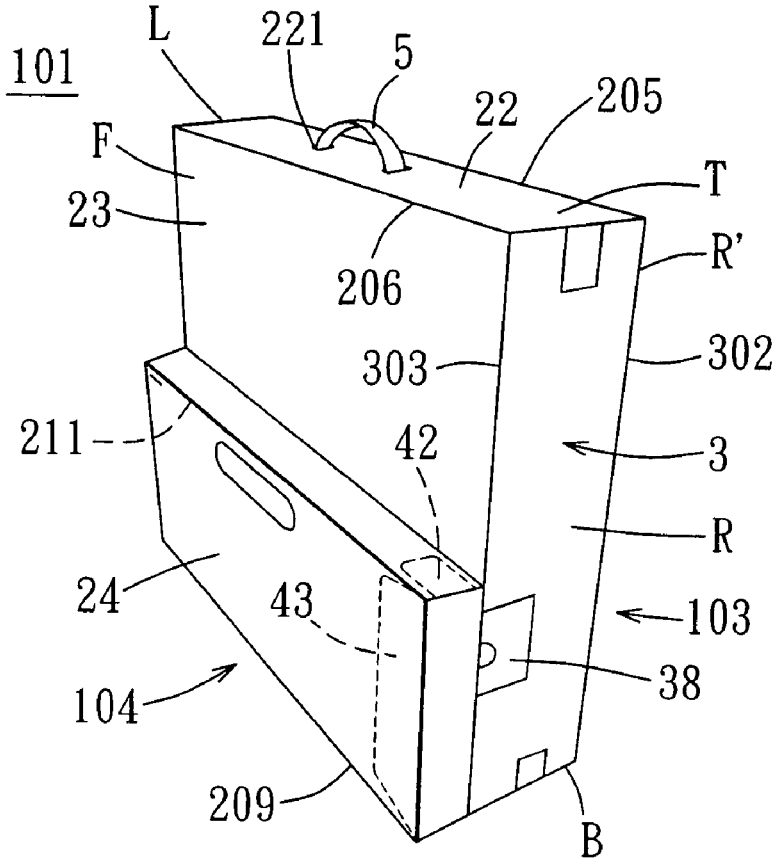
FIG. 6 is a perspective view showing that the preferred embodiment has been formed into the unit body-packaging box.

To package the computer housing in the collapsed configuration, the packaging plate 100 of this preferred embodiment may be folded to form a unit body-packaging box 101 shown in FIG. 6. The box 101 includes a main body-receiving section 103 to receive a main body of the computer housing, and a front panel-receiving section 104 to receive a front panel of the computer housing.

Referring to FIGS. 3-6, the method of folding the packaging plate 100 is described as follows:

(1) The main plate sections 31 of the two side plate portions 3 are folded perpendicularly and inwardly along the fold lines (A)/302, (B)/303, (C)/304, and the first fixing sections 32 are folded and partially stacked at a part (S) so that the first fixing sections 32 are perpendicular to the respective main plate sections 31. In this state, the areas between the fold lines (A)/302 and (B)/303 of the main plate sections 31 become the sidewalls of the box 101. Two spaced apart apertures 341, 351 are formed at the juncture between the main plate section 31 and each first fixing section 32. Tabs 342, 352 are formed by cutting across the middles of the respective apertures 341, 351. Furthermore, each fold line (B)/303 is provided with a long aperture 36 and an aperture 37 that are spaced apart from each other. A tab 38 is cut across the long aperture 36. The functions thereof will be described hereinafter.

(2) The area between the first short side 201 and the second fold line 204 is used to define a bottom wall region 21. The elongated plate portion 2 is folded inwardly along the second fold line 204 and the first fold line 203. The bottom wall region 21 has two sides each of which has spaced apart projecting plates 213, 214. Interior apertures 215, 216 are provided respectively at the junctures between the projecting plates 213, 214 and the bottom wall region 21. The projecting plates 213 can be inserted fittingly into the respective apertures 341 in the side plate portions 3, whereas the interior apertures 215 permit insertion and fixing of the respective tabs 342 therein. The other apertures and projecting plates, which perform the same interlocking actions to reinforce connections, will be described briefly hereinafter only in terms of the locations thereof. The projecting plates 214 are to be inserted respectively into adjacent parts of the long apertures 36.

3. An area between the third and fourth fold lines 205, 206 of the elongated plate portion 2 is used to define a handle region 22 on which are provided two fixing holes 221 to fix a handle 5. The handle region 22 has two sides provided respectively with projecting plates 222 each having an interior aperture 223. When the elongated plate portion 2 is folded along the third fold line 205, the projecting plates 222 can be inserted into the respective apertures 341 of the side plate portions 3, and the tabs 342 can be inserted into the respective interior apertures 223.

4. An area between the fourth and sixth fold lines 206, 208 of the elongated plate portion 2 is used to define a front wall region 23. The elongated plate portion 2 is folded along the fourth fold line 206. The front wall region 23 has two sides each of which has a long projecting plate 231 and a projecting plate 232 that are spaced apart from each other and that are provided respectively with interior apertures 233, 234. The long projecting plate 231 and the projecting plate 232 can be inserted respectively into another portion of the long aperture 36 and the aperture 37.

5. An area between the sixth fold line 208 and the second short side 202 is used to define a front panel-receiving section 104 (FIG. 6). An area between the seventh and ninth fold lines 209 and 211 is used to define an auxiliary front wall region 24. The elongated plate portion 2 is folded outwardly along the sixth and seventh fold lines 208, 209 and is thereafter folded inward along the ninth fold line 211 and further inward along the tenth fold line 212 so that an area between the tenth fold line 212 and the second short side 202 and an area between the ninth and tenth fold lines 211 and 212 overlie each other. Afterwards, the wing portions 4 are folded oppositely so that the main wings 41 are formed into the sidewalls of the front panel-receiving section 104, the auxiliary plates 43 abut against the auxiliary front wall region 24, and the auxiliary plates 44 abut against the front wall region 23. The insert plates 42 are inserted laterally to extend between the aforesaid two areas that overlie each other. In addition, an aperture 440 is provided at the juncture between each auxiliary plate 44 and the main wing 41 of the respective wing portion 4, and has substantially the same length as the respective interior aperture 233 so that each tab 38 can be inserted and fixed in the respective aperture 440. Furthermore, two spaced apart tabs 235 are formed by cutting across the sixth fold line 208, and each tab 235 is provided with an interior aperture 236. Two apertures 217 formed in the first fold line 203 have substantially the same length as the tabs 235, and two tabs 218 having a width substantially equal to the length of the interior apertures 236 are formed by cutting across the first fold line 203.

Following the aforesaid folding operation, the unit body-packaging box 101 as shown in FIG. 6 is formed. In FIG. 3, D1 and D2 are the thickness/width and the height of the main body-receiving section 103 of the packaging box 101, respectively, whereas D3 and D4 are the thickness/width and the height of the front panel-receiving section 104.

Figure 7:
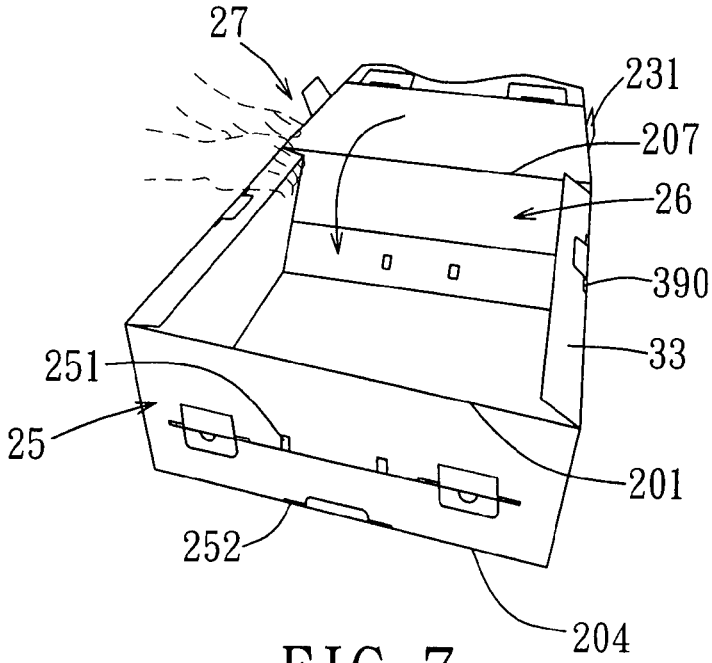
FIG. 7 is a perspective view showing the preferred embodiment that undergoes a folding operation to form a system-packaging box.
Figure 8:
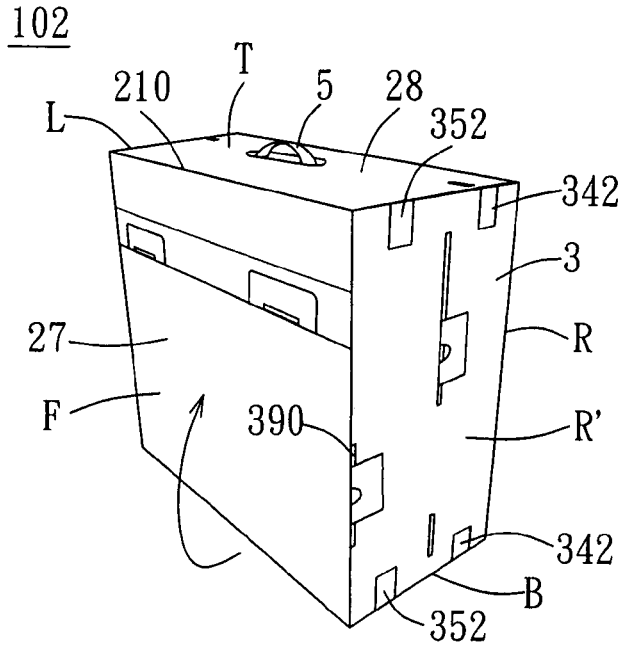
FIG. 8 is a perspective view showing that the preferred embodiment has been formed into the system-packaging box.

In order to package the computer housing that is in a non-collapsed configuration at the marketing end, the unit body-packaging box 101 shown in FIG. 6 may be disassembled to unfold the packaging plate 100, and the packaging plate 100 may be folded once again to form a system-packaging box 102 shown in FIG. 8. The folding operation for forming the system-packaging box 102 is described hereinafter and illustrated in FIGS. 3, 7 and 8.

(1) As the thickness/width of the computer housing in the non-collapsed configuration is increased compared to that in the collapsed configuration, the area between the first short side 201 and the second fold line 204 of the elongated plate portion 2 is used to define a top wall inner ply 25 of the system-packaging box 102. Two spaced apart fixing holes 251 are provided in the middle of the top wall inner ply 25 to fix the handle 5. The main plate sections 31 of the side plate portions 3 are spread out entirely rather than being folded so as to be used as the sidewalls of the system-packaging box 102. The projecting plates 213, 214 are inserted into the respective apertures 341, 351 in the side plate portions 3, and the tabs 342, 352 are inserted into and fixed in the respective interior apertures 251, 216.

(2) The area between the third and fifth fold lines 205, 207 of the elongated plate portion 2 is used to define a bottom wall region 26. The elongated plate portion 2 is folded along the third fold line 205. The projecting plates 222, 232 at two sides are inserted into the respective apertures 341, 351, whereas the tabs 342, 352 are inserted into and fixed in the respective interior apertures 223, 234 so that the bottom wall region 26 becomes a bottom wall of the system-packaging box 102.

(3) The area between the fifth and eighth fold lines 207, 210 is used to define a front panel region 27. In this state, as the wing portions 4 are not needed, they are removed. Each side portion 3 has an aperture 390 in the vicinity of the fold line (C) or 304, and is cut to form a tab 391. The front panel region 27 is fixed by inserting the long projecting plate 231 into the aperture 390 and inserting the tab 391 into the interior aperture 233.

(4) Finally, the area between the eighth fold line 210 and the short side 202 is used to define a top wall outer ply 28. A fixing insert plate 281 projects from the second short side 202, and is provided with an aperture 282. An aperture 252 is formed on the second fold line 204 and has substantially the same length as the fixing insert plate 281. A tab 253 is formed by cutting across the aperture 252. The elongated plate portion 2 is folded inward along the eighth fold line 210 so that the top wall outer ply 28 extends over and covers the outer side of the top wall inner ply 25. When the fixing insert plate 281 is inserted into the aperture 252 and when the tab 253 is inserted into the aperture 282, the top wall outer ply 28 is fixed. An opening 280 is formed in the top wall outer ply 28. Through the opening 280, the handle 5 fitted in the fixing holes 251 is permitted to extend outward from the top wall outer ply 28.

Following the aforesaid procedure, the system-packaging box 102 shown in FIG. 8 is formed. The thickness/width of the system-packaging box 102 is twice the distance D1, and the height thereof is D2.

Referring back to FIGS. 6 and 8, the single-piece packaging plate 100 is foldable to form a first box, such as the unit body-packaging box 101, or a second box, such as the system-packaging box 102. The first box has a main receiving section, such as the main body-receiving section 103, and an auxiliary receiving section, such as the front panel-receiving section 104. Each of the second box and the main receiving section of the first box has top and bottom walls, left and right walls, and front and rear walls shown at (T), (B), (L) (R), (F) and (R') in FIGS. 6 and 8. The main receiving section of the first box, and the second box have the same height in a top-to-bottom direction, the same length in a left-to-right direction, and different widths/thicknesses in a front-to-rear direction. The thickness/width of the second box is larger than that of the first box. The auxiliary receiving section projects from the front wall of the main receiving section, and has a length substantially the same as that of the main receiving section and a height smaller than that of the main receiving section.

In sum, the single-piece packaging plate 100 is foldable to form boxes having different sizes according to the present invention. With the use of the aforesaid preformed fold lines, apertures and projecting plates, the packaging plate 100 may be folded in different manners to form different packaging boxes having varying dimensions so as to accommodate various configurations of a product to be packaged.

While the present invention has been described in connection with what is considered the most practical and preferred embodiments, it is understood that this invention is not limited to the disclosed embodiment but is intended to cover various arrangement included within the spirit and scope of the broadest interpretation so as to encompass all such modifications and equivalent arrangements.

We claim:

1. A single-piece packaging plate foldable to form boxes having different sizes, comprising:

an elongated plate portion having first and second short sides, and first to tenth parallel fold lines that are disposed serially from said first to second short sides in a spaced-apart relationship, the distances between said first and second fold lines, between said third and fourth fold lines and between said sixth and eighth fold lines being D1, the distances between said second and third fold lines, between said fourth and sixth fold lines, and between said fifth and eighth fold lines being D2, D2 being greater than D1;

two side plate portions projecting respectively from two sides of an area between said second and third fold lines of said elongated plate portion, said elongated plate portion and each of said side plate portions having a fold line (A) at a juncture therebetween, each of said side plate portions having a fold line (B) and a fold line (C) that are spaced apart in parallel from said fold line (A), a distance from said fold line (A) to said fold line (B) being D1, a distance from said fold line (A) to said fold line (C) being substantially equal to a distance from said second fold line to said first short side of said elongated plate portion and a distance from said third fold line to said fifth fold line; and two wing portions that can be removed optionally from said elongated plate portion, each of said wing portions having a main wing projecting from one side of an area between said sixth and seventh fold lines of said elongated plate portion, said main wing having a length substantially equal to a distance from said seventh fold line to said ninth fold line.

2. The single-piece packaging plate as claimed in claim 1, wherein a distance from said fold line (A) to said fold line (C) is substantially equal to that from said eighth fold line to said second short side.

3. The single-piece packaging plate as claimed in claim 1, wherein each of said wing portions further includes an insert plate extending from a free end of said main wing, and two auxiliary plates extending respectively from two long sides of said main wing.

4. The single-piece packaging plate as claimed in claim 1, wherein the distances between said sixth and seventh fold lines, between said ninth and tenth fold lines, and between said tenth fold line and said second short side are substantially the same.

5. The single-piece packaging plate as claimed in claim 1, wherein each of said side plate portions is substantially rectangular, and includes a main plate section connected to a long side of said elongated plate portion, two first fixing sections respectively connected to two short sides of said main plate section, and a second fixing section connected to a long side of said main plate section, said main plate section and said second fixing section being separated by said fold line (C).

6. The single-piece packaging plate as claimed in claim 5, wherein said elongated plate portion further has a plurality of spaced-apart projecting plates provided at two sides of areas between said first short side and said second fold line of said elongated plate portion, and between said third and fifth fold lines, each of said side plate portions further having a plurality of apertures provided at said fold line (B), in the vicinity of said fold line (C), and at junctures between said main plate section and said first fixing sections.

7. The single-piece packaging plate as claimed in claim 6, wherein said elongated plate portion further has spaced-apart projecting plates that are disposed respectively at two sides of an area between said fifth and sixth fold lines and that can be inserted into respective ones of said apertures provided at said fold lines (B) of said side plate portions, or respective ones of said apertures provided in the vicinity of said fold lines (C) of said side plate portions.

8. The single-piece packaging plate as claimed in claim 1, wherein said elongated plate portion further has two fixing holes provided in each of areas between said first short side and said second fold line and between said third and fourth fold lines, and adapted to fix a handle.

9. The single-piece packaging plate as claimed in claim 8, wherein said elongated plate portion further has an opening disposed between said eighth and said second short side and adapted to permit the handle to extend outwardly.

10. The single-piece packaging plate as claimed in claim 1, wherein said elongated plate portion further has a fixing insert plate extending from said second short side, and an aperture disposed at said second fold line and having substantially the same length as said fixing insert plate.

* * * * *